US007976486B2

(12) United States Patent
Raley et al.

(10) Patent No.: US 7,976,486 B2
(45) Date of Patent: Jul. 12, 2011

(54) APPARATUS FOR FACILITATING CIRCULATION

(76) Inventors: Thomas Raley, Hanover, PA (US); Phillip March, Holland, MI (US); Mark Brummel, Jenison, MI (US); Eldon Nyhof, Zeeland, MI (US); John Lindahl, Fruitport, MI (US); Jerry Kulas, Holland, MI (US)

( * ) Notice: Subject to any disclaimer, the term of this patent is extended or adjusted under 35 U.S.C. 154(b) by 920 days.

(21) Appl. No.: 11/545,809

(22) Filed: Oct. 10, 2006

(65) Prior Publication Data

US 2007/0213650 A1 Sep. 13, 2007

Related U.S. Application Data

(60) Provisional application No. 60/833,707, filed on Jul. 27, 2006, provisional application No. 60/724,969, filed on Oct. 7, 2005.

(51) Int. Cl.
*A61H 9/00* (2006.01)

(52) U.S. Cl. ..... 601/152; 601/149; 601/150

(58) Field of Classification Search ..... 601/148, 601/149, 150, 151, 152; 606/201, 202; 600/16–20; 128/DIG. 20, 898
See application file for complete search history.

(56) References Cited

U.S. PATENT DOCUMENTS 6,296,617 B1 * 10/2001 Peeler et al. ..... 601/152
6,494,852 B1 * 12/2002 Barak et al. ..... 601/151
6,786,879 B1 9/2004 Bolam et al.

* cited by examiner

*Primary Examiner* — Quang D Thanh
(74) *Attorney, Agent, or Firm* — The Watson I.P. Group, PLC; Jovan N. Jovanovic; Vladen M. Vasiljevic

(57) ABSTRACT

A circulation facilitating apparatus comprising a pneumatic assembly and first and second leg assemblies. The pneumatic assembly comprises a pump assembly, a control assembly, an air controller assembly and an energizing assembly. The control assembly controls the pump assembly. The control assembly includes a microprocessor and a system for programming the microprocessor. The programming system programs at least a cycle time and at least a hold time. The air controller assembly is coupled to the pump assembly. Each leg assembly includes a bladder, an air passage assembly and a housing. A treatment method is likewise disclosed.

9 Claims, 7 Drawing Sheets

APPARATUS FOR FACILITATING CIRCULATION

CROSS-REFERENCE TO RELATED APPLICATION

This application claims priority of U.S. Application Ser. No. 60/833,707, entitled Apparatus for Facilitating Circulation filed Jul. 27, 2006, to U.S. Application Ser. No. 60/724,969 entitled Apparatus for Facilitating Circulation filed Oct. 7, 2005, the entire specification of each is incorporated by reference herein.

BACKGROUND OF THE INVENTION

1. Field of the Invention

The present invention relates in general to medical devices, and in particular, to an apparatus of facilitating the circulation of blood within a patient.

2. Background Art

Blood clotting is a highly serious side effect of many medical procedures and medical conditions. A blood clot within the body of a patient can cause a cardiac arrest or a stroke in a patient. As such, it is highly important to preclude the clotting of blood in a patient.

Certain solutions that have been utilized to facilitate the circulation of blood comprise heavy equipment which is maintained in hospitals and clinics. To use such equipment, a patient must first go to the hospital or clinic to undergo the procedure. During the procedure the patient is generally immobilized and precluded from movement away from the heavy equipment. Moreover, as the procedure necessarily requires the use of hospital or clinical facilities, the cost associated with such a treatment is often in excess of that which a patient can reasonably afford.

Other equipment, while transportable, is generally incapable of adjustment or customization. Specifically, such systems are not able to adjust cycle time, hold time, or other parameters, instead relying on a preprogrammed set of parameters.

Accordingly, it is an object of the invention to provide an apparatus which can facilitate the circulation of blood within a patient, but which is usable in a variety of locations both inside and outside of a hospital or clinic.

It is another object of the invention to provide a portable apparatus which facilitates the circulation of blood.

It is another object of the invention to provide an apparatus which facilitates the circulation of blood while not precluding the patient to proceed with normal daily activity.

It is another object of the invention to provide an apparatus which facilitates the circulation of blood while permitting extensive user adjustment of various parameters of the treatment.

These objects as well as other objects of the present invention will become apparent in light of the present specification, claims, and drawings.

BRIEF DESCRIPTION OF THE DRAWINGS

The invention will now be described with reference to the drawings wherein.

DETAILED DESCRIPTION OF THE INVENTION

Figure 1:
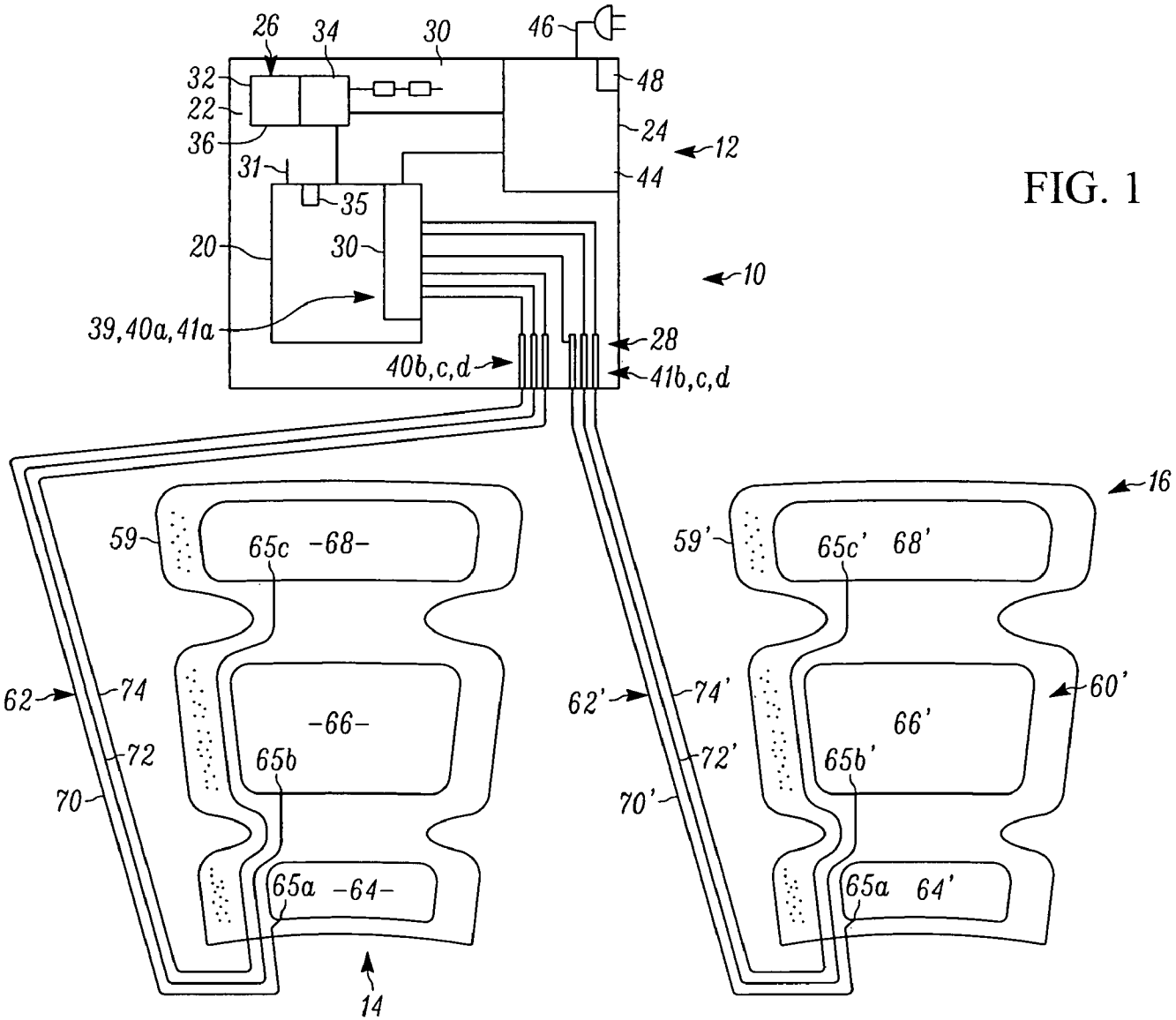
FIG. 1 of the drawings is a schematic view of the system of the present invention.

While this invention is susceptible of embodiment in many different forms, there is shown in the drawings and described herein in detail a specific embodiment with the understanding that the present disclosure is to be considered as an exemplification of the principles of the invention and is not intended to limit the invention to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, circulation facilitating apparatus 10 for facilitating circulation of blood within a patient (and, in turn, precluding the clotting of blood) is shown as comprising pneumatic assembly 12, first leg assembly 14 and second leg assembly 16. It is contemplated that apparatus 10 can be utilized by a patient in a hospital setting, or in a home setting. In addition, it is contemplated that the such units may comprise a single patient item which is discarded after use by a patient. Of course, it is contemplated that the apparatus may be provided on a rental basis, wherein patients can sequentially utilize the device.

The pneumatic assembly 12 includes pump assembly 20, control assembly 22 and energizing means 24. It is preferred that the pneumatic assembly comprise a portable device which is capable of being worn on a user's belt, in a purse, a fanny pack or the like. Such a device gives the user the requisite mobility. In particular, a user can utilize the device on an airplane, in a vehicle or on a boat. Thus, the user's mobility is greatly enhanced. Moreover, the usage can be in situations wherein blood clots generally develop.

Pump assembly 20 comprises a conventional air pump which includes inlet 31 and outlet 33 as well as pressure transducer 35. Inlet 31 is generally unconstrained and capable of accepting outside air. In certain embodiments, the inlet may include a net, a filter or the like to preclude the ingress of foreign objects (insects, foreign objects, coins, etc.). Additionally, inlet 31 may include a structure which limits the ability of an outside object to limit flow to the pump. In certain embodiments, a muffler can be provided to minimize the noise of the pump. As will be explained, the outlet is attached to the control assembly. Power is provided to the pump assembly by way of the energizing means.

Pump control assembly 22 includes control unit 26 and air controller subassembly 28. Control unit 26 includes microprocessor means 34, means 30 for programming the microprocessor, means 32 for storing data and display member 36. As will be explained below, the microprocessor controls the overall operation of the apparatus. Programming means 30 may comprise a plurality of buttons, a touch screen, switches, among other structures which are coupled to the microprocessor. The pressure transducer 35 is likewise coupled to the microprocessor means. The buttons facilitate the input by a user of the desired operating parameters, such as, for example, cycle time, hold time, individual bladder inflation, the pressures of the bladders, the inflation and deflation rates, etc. In the embodiment shown, the input means comprises a pair of buttons which can be depressed in a particular combination or pattern to achieve any one of a number of different effects.

Data storage means 32 may comprise memory which is capable of receiving data from the microprocessor as to the present condition of the device and the treatment that has been administered over a previous period of time. In addition, the data storage means 32 may store a number of preprogrammed modes of operation which can be recalled by the user, instead of manual programming of the device. A communication means may be provided for purposes of storing or retrieving data from the data storage means. For example, and among a number of different contemplated communication means, the communication means may comprise a USB connection, an IR connection, a RF connection and/or a Bluetooth connection. In other embodiments, in the place of communication means or in addition to communication means, the data storage means may comprise flash memory in any one of a number of standard configurations (CF, SD, MMC, SM, XD, MS, etc.) such that data can be stored and retrieved from the flash memory on separate equipment and inserted into the apparatus as needed.

Display member 36 may comprise any one of a number of different devices which are capable of providing output to a user. For example, the display may comprise a plurality of LED elements which selectively illuminate to identify the particular condition or operation of the device. In other embodiments, such as those embodiments wherein the user is desirous of receiving as much information as possible, a VF display, a LED display, a LCD display or a OLED display may be provided. Such a display may be capable of displaying alpha numeric characters as well as pictures, graphics, charts and the like. Such an enhanced display provides the user with additional useful information.

Air controller subassembly 28 is shown in FIG. 1 as comprising a two position solenoid 39 which directs air to one of the right leg assembly and the left leg assembly. To control the right leg assembly, vent solenoid 40*a*, as well as a leg solenoids 40*b*, 40*c* and 40*d* are provided. To control the left leg assembly, vent solenoid 41*a*, as well as solenoids 41*b*, 41*c* and 41*d* are provided. The microprocessor controls the solenoids and directs the solenoids into one of two different positions, a position wherein air is allowed to flow through the solenoid passage and a second position wherein the passage of air is precluded. It is the precise control of these solenoids that facilitates the operation of the device. As will be explained, each solenoid has an air passage that is coupled to outlet 33 of pump assembly 20 and to a respective bladder or to ambient.

Energizing means 24 comprises a plurality of secondary cells, such as secondary cell 44, recharging controller 48 and AC source input 46. The energizing means provides the necessary power to the pump assembly and the control assembly. The secondary cells are rechargeable through power from AC source input 46 and the recharging of the device is governed by recharging controller 48. In certain embodiments, the energizing means (or portions thereof) can be detachable from the device in the form of a battery pack. In such an embodiment, the user can carry multiple battery packs for extended trips or extended periods of usage wherein the user is generally not positioned proximate an AC source. The AC source input may include a built-in transformer, or may require the use of an outside transformer. Additionally, other power adapters, such as automobile 12V adapters may be provided.

First leg assembly 14 and second leg assembly 16 are generally identical. As such, first leg assembly will be described with the understanding that the second leg assembly is substantially identical and will include the same reference numbers augmented by a prime (′). First leg assembly 14 includes housing 59, bladder assembly 60 and air passage assembly 62. Housing 59 comprises a flexible (generally fabric) material which is capable of being positioned circumferentially around the leg of a user while containing the bladder assembly. Typically such a material comprises an elongated fabric member which includes hook and loop fasteners which facilitate the maintenance of the material around the leg of a user. In other embodiments, alternative structures and fasteners may be utilized to insure that the housing is maintained around the leg of the user. Such fasteners may include snaps, buttons, clips, straps, adhesive, tape, among others. Preferably, the housing has a length equal to the distance between the user's knee and ankle. In other embodiments, the housing may have a length that is shorter or a length which extends above the knee.

Bladder assembly 60 is shown in FIG. 1 as comprising three separate chambers, namely first chamber 64, second chamber 66 and third chamber 68. The chambers are separate from each other and spatially maintained in a proper orientation through the attachment of the chambers to housing 59. Each of the chambers includes an opening 65*a* through 65*c* for fluid communication with the cavity defined by each chamber. The bladders typically comprise a polymer material or a synthetic or natural rubber material. Of course, the invention is not limited to any particular configuration or material for the bladder assembly. Moreover, the invention is not limited to a particular number of bladders and a greater or a lesser number of bladders is contemplated.

Figure 2A:
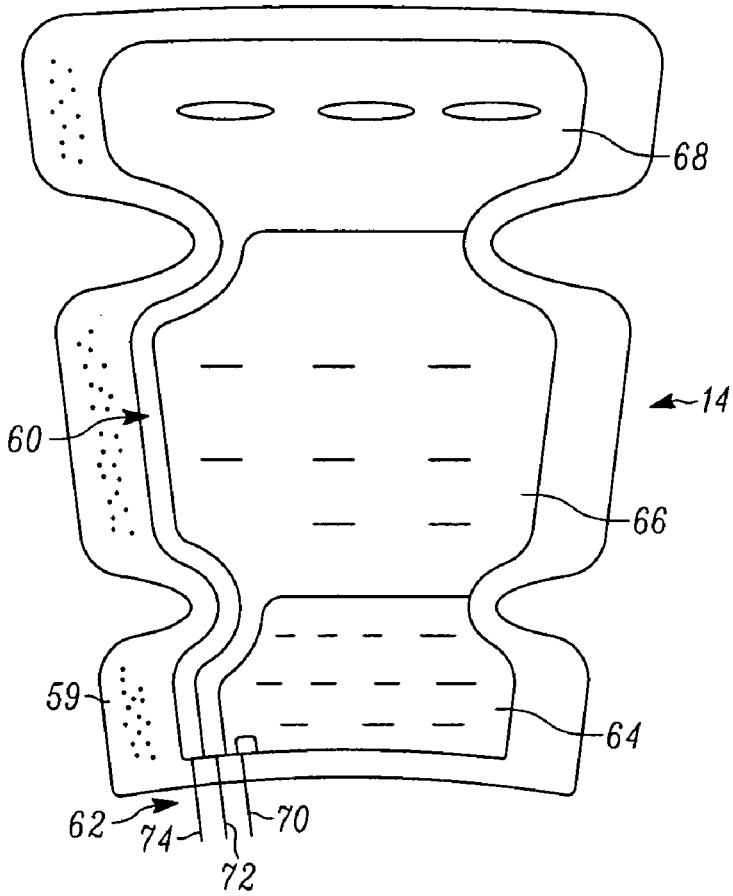
FIG. 2*a* of the drawings is a schematic view of an alternate bladder assembly of the present invention, showing an integrated bladder assembly wherein each of the bladders are defined by heat seals to a single large bladder member.
Figure 2B:
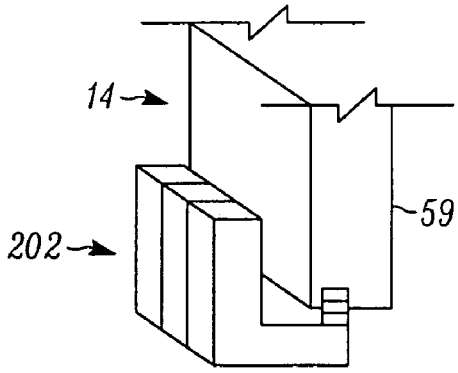
FIG. 2*b* of the drawings is a perspective view of an elbow of the present invention.

In certain embodiments, such as is shown in FIG. 2*a*, the bladder assembly 60 may comprise a single integrated member having a plurality of different chambers. The chambers are defined by heat seals in the bladder assembly. In such an embodiment, the openings for each of the chambers can likewise be defined as elongated passageways defined by heat seals. As such, the openings can be positioned proximate each other while the chambers may be positioned at a distance from the respective openings. In such an embodiment, and as is shown in FIG. 2*b*, elbow 202 may be provided. Elbow 202 comprises a substantially "U" shaped member which is coupled to the three openings at the first end and to each of the three passageways. Inasmuch as the openings are generally positioned proximate the ankle region, and, as such, the "U" shaped member minimizes the chances of improper kinking and/or bending of the various components.

Air passage assembly 62 comprises tubes or other members capable of linking the pump assembly with the bladder assembly. In the embodiment shown, an air passage is provided for each chamber. In particular, passageway 70 provides fluid communication between the pump assembly and first chamber 64. Passageway 72 provides fluid communication between the pump assembly and second chamber 66. Passageway 74 provides fluid communication between the pump assembly and third chamber 68. It will be understood that air controller subassembly 28, and in particular each solenoid is connected at an input to pump assembly 20 and at a second end to the respective passageway of the leg assembly.

In the embodiment shown, each passageway comprises a clear polymer tubing which is flexible. Such a tubing may be provided as three separate tubing members or, each of the tubing members can be attached to each other. In other embodiments, the tubing may comprise rigid portions (to preclude clamping, pinching or other adverse condition to the tubing). In other embodiments, the tubing may comprise a fully rigid system. The passageways may comprise a clear material, a translucent material or an opaque material.

In operation, the user first determines the parameters of the treatment. The device allows for the user setting of a number of different parameters. For example, the user may simply select a treatment which inflates the first leg assembly and holds the inflated configuration for a period of 10 seconds, whereupon the air is released. Next, the second leg assembly is inflated and held for a period of 10 seconds, whereupon the air is released. The system then waits for the balance of, for example a 75 second treatment period before beginning. The user can set the upper pressure that is to be reached by the device.

Once the parameters are set, the user can extend housing 59 of each of the first and second leg assemblies around the respective leg. The system is then activated. The microprocessor directs the air pump to pump air. The solenoids are configured such that solenoid 40*a* is blocked (thus, precluding the venting of the air from within the system) and such that solenoids 40*c* and 40*d* are blocked. Solenoid 40*b* allows a fluid passage thereacross and into the first chamber 64 of the first leg assembly. Once a desired pressure is reached (which pressure is measured by the pressure transducer 35, the solenoid 40*b* is shut, and only solenoid 40*c* is opened to permit the direction of air into the second chamber 66 of the first leg assembly. Finally, the solenoid 40*d* is blocked and solenoid 40*d* is opened to permit the direction of air into the third chamber 68 of the first leg assembly. The respective solenoids 40*b* through 40*d* close when a desired predetermined pressure is reached in each of the chambers, or after a predetermined period of time has elapsed. The first leg assembly is fully inflated at this point.

Once the set pressures and hold times have been achieved, the microprocessor directs each of the solenoids 40*b* through 40*d* into a condition wherein they are open, and opens vent solenoid 40*a*. Each of the chambers 64, 66 and 68 are thereby vented. Next, the microprocessor directs solenoid 39 to direct air only to the second leg assembly. At such time solenoid 41*a* is closed (precluding venting) and air is sequentially directed through solenoids 40*b*, 40*c* and 40*d*. until the second leg assembly is fully pressurized to a desired pressure in a manner similar to the process identified above with respect to the first leg assembly. This pressure is maintained for the desired period of time. Again, the solenoids can be individually directed into an "off" state as the desired pressure is reached. It is desired that the pressure in the first chamber 64 be greater than the pressure in chamber 66 which is greater than the pressure within chamber 68. Thus, each chamber has a successively lower pressure. Once the pressures and hold times have been achieved, the microprocessor directs each of the solenoids 41*b* through 41*d* to a an open condition and vent valve 41*a* is opened to vent the air to ambient.

Per the programming of the user, the microprocessor waits for the balance of the treatment cycle then begins the process again. This process is repeated for a desired period of time. It is contemplated that the energizing means (self contained) can power the device for a period of at least 10 hours, thereby allowing for the device to be used during excessively long flights and meetings.

In another embodiment of the invention, a single air controller can be provided in the controller assembly and a single air passage assembly can be provided. In such an embodiment, the first chamber is attached to the second chamber and the second chamber is attached to the third chamber. Between each attached chamber is a pressure relief valve. In such an embodiment, each chamber is filled sequentially and each subsequent chamber is inflated to a lower pressure which is controlled by the relief valves. As such, the system can be greatly simplified by requiring only a single tubing member to extend between the leg assembly and the pneumatic assembly.

Figure 3:
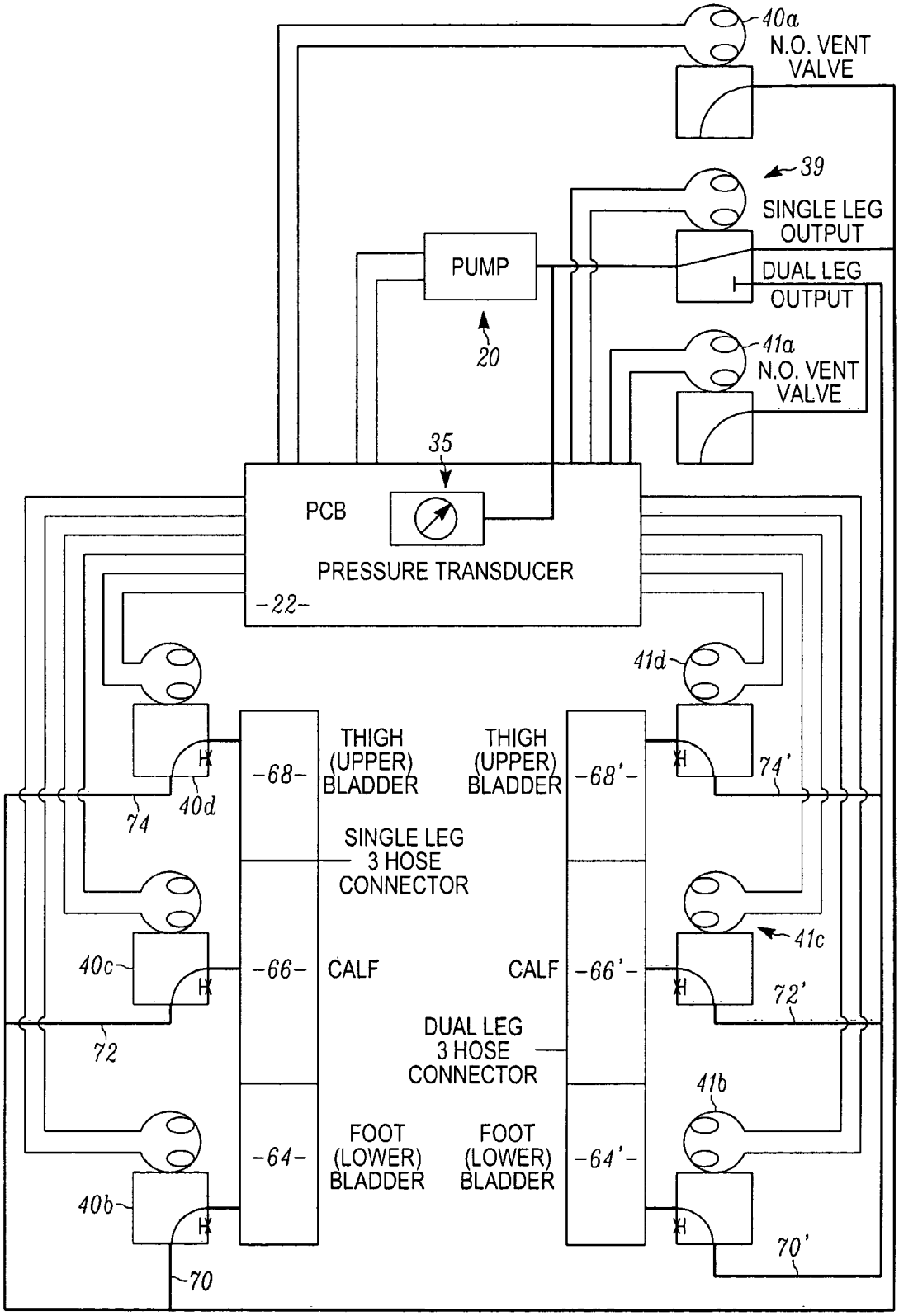
FIG. 3 of the drawings is a schematic view of a first embodiment of the invention.
Figure 4:
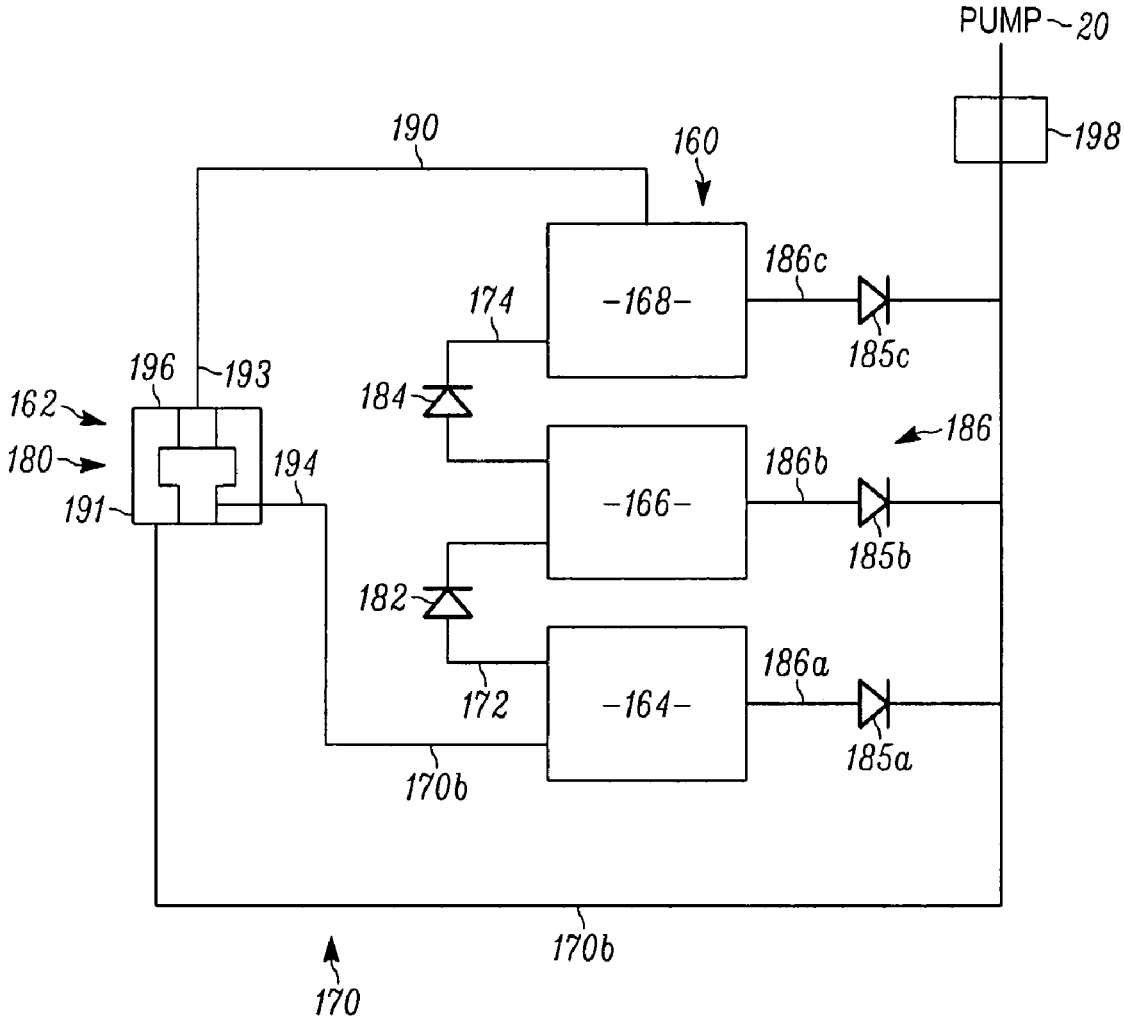
FIG. 4 of the drawings is a schematic view of a second embodiment of the invention.

More specifically, and as is shown in FIG. 3, bladder assembly 160 is shown as including first chamber 164, second chamber 166 and third chamber 168. Air passage assembly 162 includes first differential piston 180, first passageway 170, second passageway 172, third passageway 174, vent passageway assembly 186, and return passageway 190.

Differential piston 180 includes first inlet 191, second inlet 193, outlet 194 and piston 196. Piston 196 comprises a differential piston such that the surface area of the piston exposed to second inlet 193 is larger than the surface area of the piston exposed to first inlet 191. The piston is movable from a first position wherein fluid communication is established between first inlet 191 and outlet 194 to a second position wherein fluid communication between the first inlet and the outlet is precluded. The fluid communication is precluded when a pressure of 0.5 psi is presented at the second inlet.

First passageway 170 includes first component 170*a* extending between pump assembly 20 and first inlet 191, and second component 170*b* extending between outlet 194 of the differential piston and first chamber 164. Second passageway 172 includes first check valve 182 (also commonly referred to as a pressure relief valve) and extends between first chamber 164 and second chamber 166. The check valve is configured such that it does not open until a predetermined pressure is reached within the first chamber 164. Third passageway 174 includes second check valve 184 and extends between second chamber 166 and third chamber 168. The second check valve is configured such that it does not open until a predetermined pressure is reached within the second chamber. The second check valve opens at a lower pressure than the first check valve. In the embodiment shown, the first check valve opens at 1 psi and the second check valve opens at 0.7 psi.

Return passageway 190 extends between third chamber 168 and second inlet 193 of differential piston 180. Vent passageway assembly 186 comprises three passageways 186*a* through 186*c* which extend from a respective chamber to the first component of the first passageway. Each passageway assembly includes check valves 185*a* through 185*c*. The check valves are designed to open when the pressure in first passageway component 170*a* is less than the pressure in each respective chamber 164 through 168.

In operation of such an embodiment, the microprocessor is again configured for a 10 second hold time after pressurization to the first leg assembly followed by a 10 second hold time after pressurization to the second leg assembly followed by a wait cycle for the balance of a treatment cycle wherein neither leg is pressurized (it will be understood that these parameters may be modified as necessary, or certain portions may be eliminated). As such, to initiate the treatment, the sole solenoid controlling the right leg assembly is activated so as to allow air to enter first passageway component 170*a*. Inasmuch as the remainder of the passageways are at a nominal pressure, the differential piston is directed toward second inlet 193, and fluid communication is established between first inlet 191 and outlet 194. In turn, air is directed into first chamber 164.

Once first chamber 164 reaches a predetermined pressure, first check valve 182 opens and air begins to enter second chamber 166. As the pressure within the second chamber increases, eventually, a pressure is reached wherein second check valve 184 is likewise opened. Once opened, air is directed to third chamber 168. In turn, the pressure begins to increase in the third chamber. Once a predetermined pressure is reached within the third chamber, the pressure within the return passageway increases such that the force against piston 196 by air entering through second inlet 193 directs the piston into a position wherein first inlet 191 becomes blocked and communication with outlet 194 is stopped. At such time, each of the first, second and third chambers is filled to a desired pressure. The pump continues to provide air into 170*a* causing the control unit to detect the pressure increase, thus stopping the pump and opening valve 198, decreasing the pressure within first passageway component 170*a* such that the vent check valves 185*a* through 185*c* open and the three chambers are emptied.

Next, the same procedure is repeated with respect to the second leg assembly. After the second leg assembly undertakes a similar procedure, the system waits at idle for the remainder of the treatment cycle, at which time the cycle is repeated. The advantage of such an embodiment is that only a single solenoid is required for each leg assembly and only one tube extends to each leg assembly. Due to the fewer solenoids, the battery life of the pump assembly increases.

Figure 5:
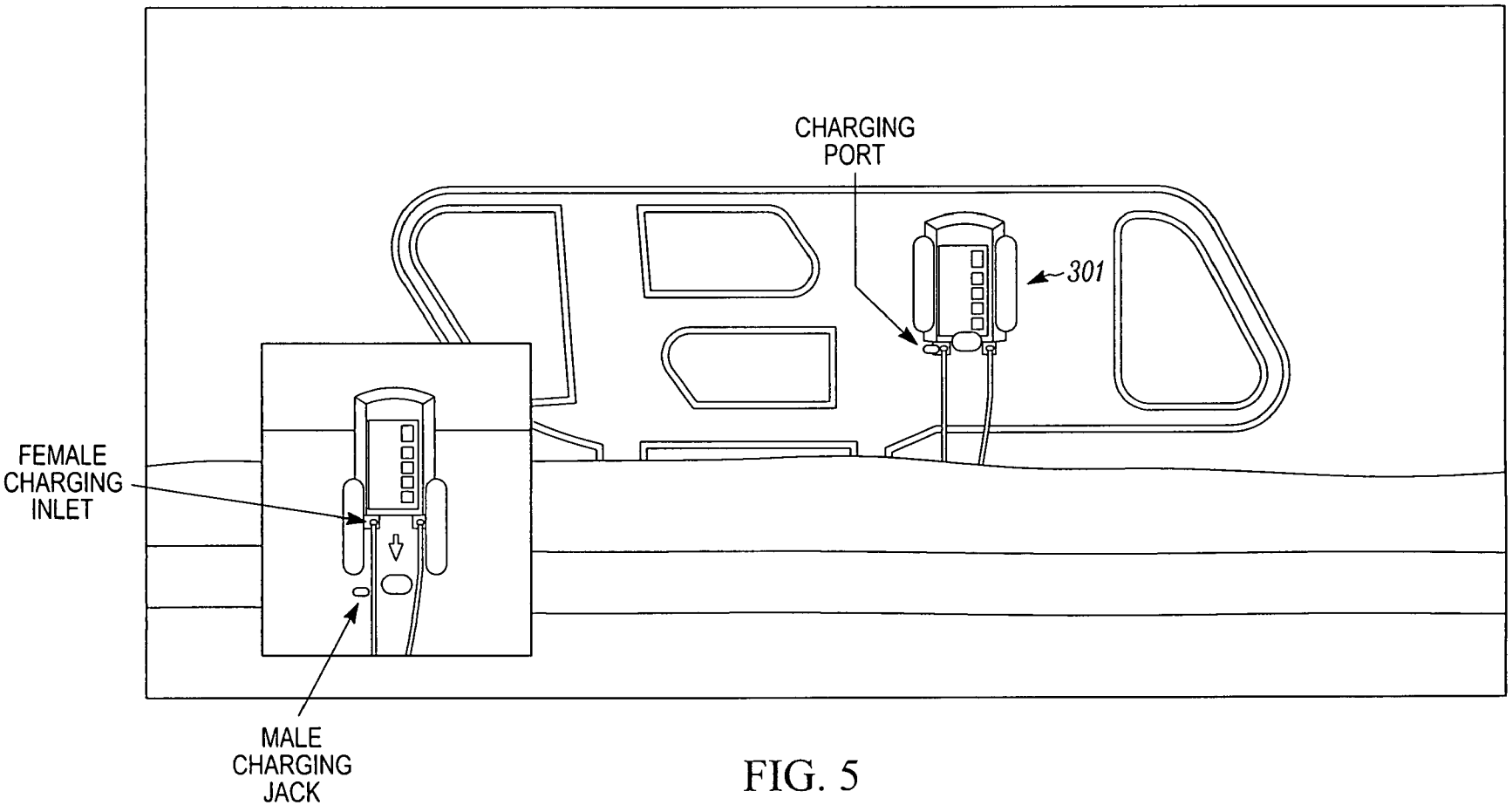
FIG. 5 of the drawings is a side elevational view of the device incorporated into a hospital bed.

While it is contemplated that the device is portable, it is likewise contemplated that the device can be incorporated into existing medical equipment. For example, the foregoing apparatus can be incorporated into a hospital bed, as is shown in FIG. 5. Specifically, a bay 301 is provided on a portion of hospital bed 303 (or hospital bed accessory). The bay is configured to releasably secure the apparatus to the bed. In the embodiment shown, it can be slid into and out of bay 301. Of course, other snap-in systems are likewise contemplated.

It is contemplated that bay 301 may include a charging jack as well as, for example data ports and the like. Consequently, the device can be charged when it is in the bay, and data pertaining to treatment can be transferred to a data storage device or a computing device. Finally, it is contemplated that the programming of the device can be different when it is inserted into bay 301 than when the device is not connected to a bay.

Figure 6:
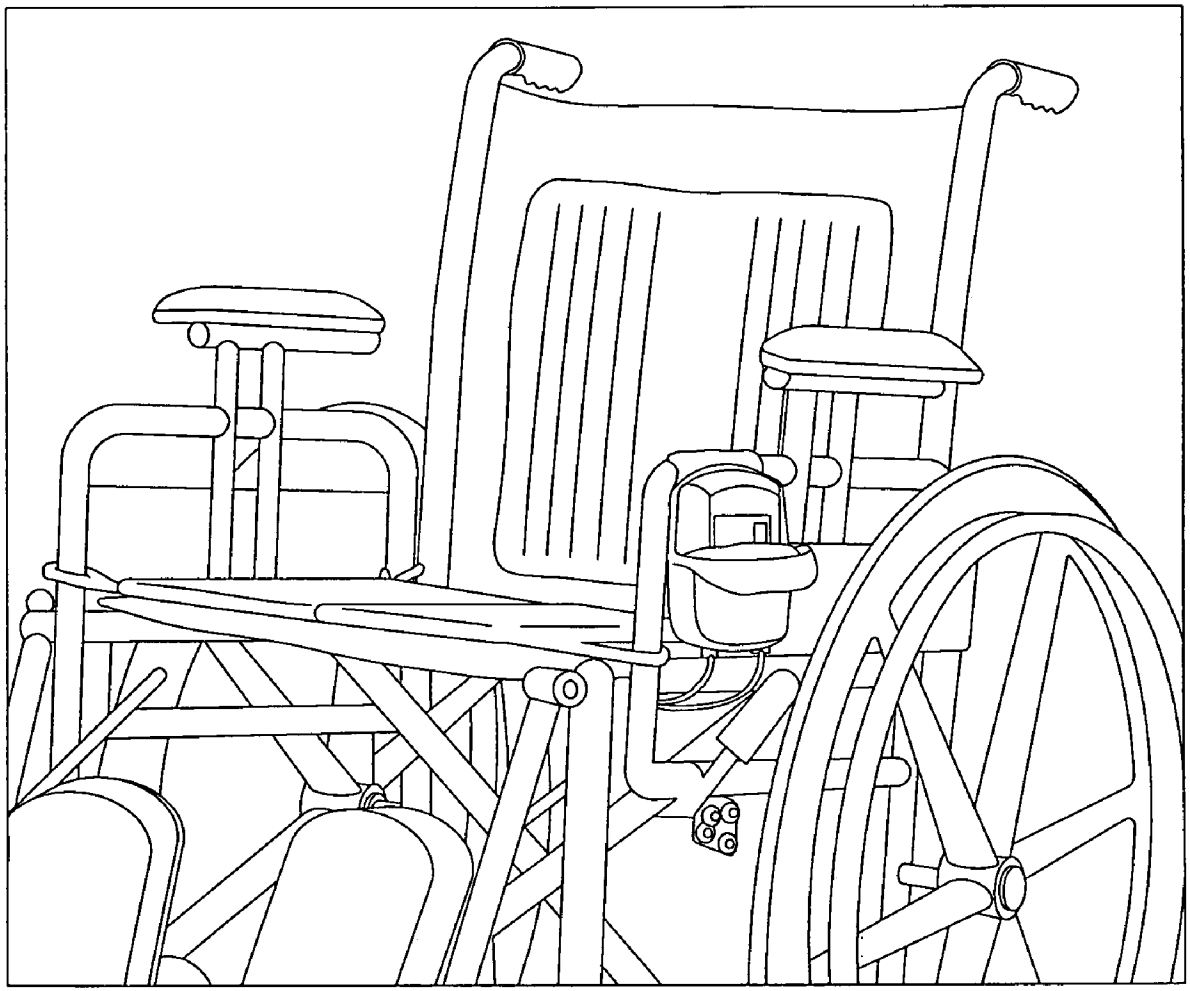
FIG. 6 of the drawings is a perspective view of the device incorporated into a wheelchair.
Figure 7:
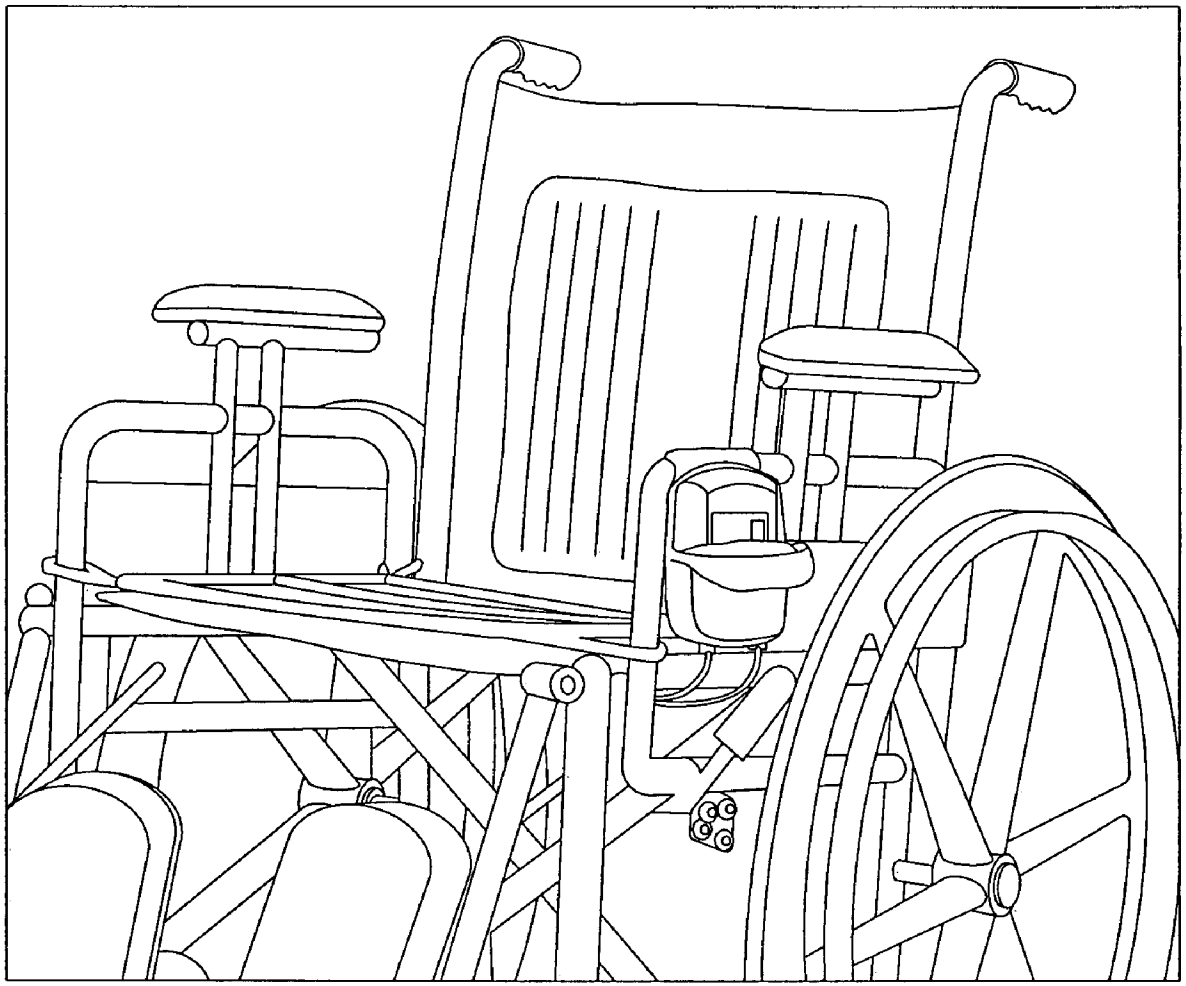
FIG. 7 of the drawings is a perspective view of the device incorporated into a wheelchair.

With reference to FIGS. 6 and 7, the device may be incorporated into a wheelchair. Specifically, modified bladders can be positioned on the seating surface of the wheelchair, and the device can be coupled to a side rail or other structure of the wheelchair. In such an embodiment, the device can facilitate the circulation while serving to minimize sores from sitting in the wheelchair.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A circulation facilitating apparatus comprising:

a pneumatic assembly comprising, a pump assembly;

a control assembly for controlling the pump assembly, the control assembly including microprocessor means and means for programming the microprocessor means;

an air controller assembly coupled to the pump assembly; and means for energizing the pump assembly, the control assembly and the air controller assembly;

a first and a second leg assembly, each leg assembly comprising:

a housing for attaching the respective leg assembly to a respective leg of a patient;

a bladder assembly having a first chamber, a second chamber and a third chamber; and an air passage assembly having, a first passageway having a first component and a second component, a second passageway having a first check valve, a third passageway having a second check valve, the second check valve having a lower opening pressure than the first check valve, a return passageway, a differential piston having a first inlet, a second inlet, an outlet and a piston member, the piston member positionable in a first position wherein fluid communication is established between the first inlet and the outlet and in a second position wherein fluid communication between the first inlet and the outlet is substantially precluded, and a return vent passageway assembly, wherein the first component of the first passageway extends from the pump assembly to the first inlet of the differential piston, the second component of the first passageway extends from the outlet of the differential piston to the first chamber, the second passageway extends between the first chamber and the second chamber, the third passageway extends between the second chamber and the third chamber, the return passageway is positioned between the third chamber and the second inlet of the differential piston, and wherein the return vent passageway assembly includes a vent passageway extending between each chamber and the first component of the first passageway, each vent passageway including a check valve which opens when the pressure in a respective chamber exceeds the pressure in the first component in the first passageway.

2. The circulation facilitating apparatus of claim 1 wherein the air controller assembly comprises a single two position solenoid coupled to each of the first and second leg assemblies.

3. The circulation facilitating apparatus of claim 1 wherein the programming means programs at least one of a cycle time, a pressure and a hold time.

4. The circulation facilitating apparatus of claim 1 wherein the control assembly further comprises a display which comprises one of an LED, a LCD and an OLED display.

5. The circulation facilitating apparatus of claim 1 wherein the control assembly further comprises means for storing data pertaining to at least one on a program for the microprocessor means and data pertaining to an administered treatment.

6. The circulation facilitating apparatus of claim 1 wherein the programming means comprises a plurality of at least one of buttons, switches and a touch screen.

7. The circulation facilitating apparatus of claim 1 wherein the energizing means comprises a plurality of secondary cells.

8. The circulation facilitating apparatus of claim 1 wherein the housing comprises a material encircling a leg of a patient having a plurality of hook and loop fasteners retaining the position.

9. A method of facilitating circulation comprising the steps of:

providing a circulation facilitating apparatus comprising:

a pneumatic assembly comprising, a pump assembly;

a control assembly for controlling the pump assembly, the control assembly including microprocessor means and means for programming the microprocessor means;

an air controller assembly coupled to the pump assembly; and means for energizing the pump assembly, the control assembly and the air controller assembly;

a first and a second leg assembly, each leg assembly comprising:

a housing for attaching the respective leg assembly to a respective leg of a patient;

a bladder assembly having a first chamber, a second chamber and a third chamber; and an air passage assembly having, a first passageway having a first component and a second component, a second passageway having a first check valve, a third passageway having a second check valve, the second check valve having a lower opening pressure than the first check valve, a return passageway, a differential piston having a first inlet, a second inlet, an outlet and a piston member, the piston member positionable in a first position wherein fluid communication is established between the first inlet and the outlet and in a second position wherein fluid communication between the first inlet and the outlet is substantially precluded, and a return vent passageway assembly, wherein the first component of the first passageway extends from the pump assembly to the first inlet of the differential piston, the second component of the first passageway extends from the outlet of the differential piston to the first chamber, the second passageway extends between the first chamber and the second chamber, the third passageway extends between the second chamber and the third chamber, the return passageway is positioned between the third chamber and the second inlet of the differential piston, and wherein the return vent passageway assembly includes a vent passageway extending between each chamber and the first component of the first passageway, each vent passageway including a check valve which opens when the pressure in a respective chamber exceeds the pressure in the first component in the first passageway;

positioning the first leg assembly around a patient;

positioning the second leg assembly around a patient;

coupling the first and second leg assembly to the pneumatic assembly;

programming the pneumatic assembly for at least cycle time and hold time;

administering a programmed treatment to each of the first leg and the second leg.

* * * * *